US005217318A

United States Patent [19]

Peppel

[11] Patent Number: 5,217,318

[45] Date of Patent: Jun. 8, 1993

[54] LOW MAINTENANCE CRASH BARRIER FOR A ROAD DIVIDER

[76] Inventor: George W. Peppel, 130 Meadow View Dr., Argyle, Tex. 76226

[21] Appl. No.: 744,992

[22] Filed: Aug. 14, 1991

[51] Int. Cl.[5] ..... E01F 13/00; E01F 15/00

[52] U.S. Cl. ..... 404/6; 256/13.1

[58] Field of Search ..... 404/6, 10; 256/1, 13.1

[56] References Cited

U.S. PATENT DOCUMENTS

| | | | |
|---|---|---|---|
| 3,416,484 | 12/1968 | Chapman | 116/67 |
| 3,602,109 | 8/1971 | Harrington | 94/1.5 |
| 3,643,924 | 2/1972 | Fitch | 256/13.1 |
| 3,674,115 | 7/1972 | Young et al. | 188/18 |
| 3,680,662 | 8/1972 | Walker et al. | 188/1 B |
| 3,695,583 | 10/1972 | Walker et al. | 256/1 |
| 3,845,936 | 11/1974 | Boedecker, Jr. et al. | 256/1 |
| 3,944,187 | 3/1976 | Walker | 256/13.1 |
| 3,951,384 | 4/1976 | Hildreth, Jr. . | |
| 3,982,734 | 9/1976 | Walker . | |
| 4,066,244 | 1/1978 | Yoho | 256/1 |
| 4,399,980 | 8/1983 | van Schie | 256/13.1 |
| 4,407,484 | 10/1983 | Meinzer | 256/13.1 |
| 4,452,431 | 6/1984 | Stephens et al. | 256/13.1 |
| 4,655,434 | 4/1987 | Bronstad | 256/13.1 |
| 4,815,565 | 3/1989 | Sicking | 188/32 |
| 4,838,523 | 6/1989 | Humble et al. | 256/13.1 |
| 5,022,782 | 6/1991 | Gertz et al. | 256/13.1 X |

*Primary Examiner*—William P. Neuder

[57] ABSTRACT

The crash barrier of the invention generally comprises a track, a series of telescoping members, one or more tensioners, and a brake system. The series of telescoping members are slidably engaged on the track. The telescoping members can successively nest within each other. The members are provided with side walls that are sufficiently strong to withstand the impact of a vehicle that veers off the road into the crash barrier. The tensioner is formed of an elastic material. The tensioner is connected between one of the telescoping members and one end of the track. When the telescoping members are fully extended, the tensioners are in a substantially relaxed state. When the members telescope together under the impact of a vehicle, the tensioners stretch, thereby absorbing the kinetic energy of the vehicle. The tensioners are retained in the strained position by a one-way brake system. The brake system can be slowly released such that the stored strain energy of the tensioners can be used to substantially restore the telescoping members of the crash barrier to the extended condition.

18 Claims, 7 Drawing Sheets

LOW MAINTENANCE CRASH BARRIER FOR A ROAD DIVIDER

FIELD OF THE INVENTION

The invention generally relates to a crash barrier and method for protecting road dividers, bridge stanchions, and other roadside structures from the crash impact of vehicles. The crash barrier absorbs the crash impact and deflects vehicles away from the protected structure. The crash barrier and method may also help minimize injury to the passengers of the vehicle by deflecting the vehicle away from roadside hazards.

BACKGROUND OF THE INVENTION

The purpose of a crash barrier is at least two-fold. The primary purpose of the crash barrier is to protect structures that are located near a road or highway from damage resulting from impacting vehicles. Repair of roadside structures such as road dividers and bridge stanchions is not only expensive, but highly disruptive to traffic flow. Given the high public awareness of traffic injuries and fatalities, another purpose of the crash barrier is to help reduce injuries to persons riding in a vehicle that would otherwise collide directly with the roadside structure.

Rigid guard rails are well known in the art to deflect the impact of a vehicle away from road hazards and to protect roadside structures. The rigid guard rails are positioned alongside the road between the general direction of traffic flow and the roadside structure. But rigid guard rails fail to provide adequate protection to the roadside structures and vehicle passengers because the guard rails absorb only a small percentage of the impact energy of the oncoming vehicle. The rail guards may also fail under the impact of the collision.

U.S. Pat. Nos. 3,674,115 and 3,944,187 disclose impact attenuation devices having an array of buffer elements wherein sections of the arrayed buffer elements are separated by diaphragms and the entire array of buffer elements is surrounded by fenders. The fenders and diaphragms, combined with a base framework and a system of cables, springs, and restraining pins hold the buffer elements in the arrayed configuration. Upon the impact of an oncoming vehicle, the sections of the arrayed buffer elements sandwich together, the fenders and diaphragms crushing onto the buffer elements. The individual buffer elements have chambers or cells formed therein. The chambers of the buffer elements disclosed in U.S. Pat. No. 3,674,115 are filled with a liquid substance. Under the impact of an oncoming vehicle, the chambers are compressed and the pressure of the fluid within the chamber increases. The pressure within the chamber is released at a controlled rate through a series of orifices so that the energy of impact is dissipated. The chambers of the buffer elements disclosed in U.S. Pat. No. 3,944,187 are filled with a solid material such as vermiculite. Under the impact of an oncoming vehicle, the volume of the chambers is compressed, which tends to load and disintegrate the vermiculite, thereby dissipating the impact energy. The buffer elements are intended to absorb some of the energy of an impacting vehicle.

The impact attenuating devices of U.S. Pat. Nos. 3,674,115 and 3,944,187 may be to some extent reusable. The base framework, diaphragms, and fenders may be pulled apart, the cables, springs, and pins reattached or replaced. The liquid or solid material in the chambers of the buffer elements can be topped off or replaced, though many if not all of the buffer elements would probably need to be replaced. After the impact attenuation devices suffer the impact of a vehicle collision, they require extensive maintenance from a maintenance crew trained to repair the particular type of impact maintenance device. Depending on the ready availability of maintenance crews and replacement parts, the impact attenuation device may not be restored to serviceability for several days or weeks. Meanwhile the roadside structure is exposed to the threat of a second vehicle impact without adequate protection. Passengers in passing traffic are also exposed to an increased risk of serious injury if a vehicle collides with the damaged impact attenuation device or the device fails under a the impact of a second collision.

U.S. Pat. No. 4,452,431 discloses an improved fender panel for these impact attenuation devices. The improved fender panels are intended to help the damaged or unrestored impact attenuation devices better withstand a second vehicle impact. The fender panels are less likely to be severely deformed upon the impact of an oncoming vehicle, therefore, the fender panels are more likely to be reusable. But despite the improved fender panels, these impact attenuation devices are expensive to maintain and require substantial road crew service after every minor impact.

SUMMARY OF THE INVENTION

The low maintenance crash barrier of the invention generally comprises a track, a series of telescoping members, one or more tensioners, and a brake system.

The track is oriented lengthwise such that one end of the track is near the roadside hazard or the roadside structure that needs to be protected and the other end of the track is oriented toward the general direction of oncoming traffic. For convenience of description, the front of the track refers to the end of the track that is generally oriented toward the direction of an expected oncoming vehicle. Any traffic that errantly veers out of the normal direction of traffic flow toward the roadside structure should impact at the front end of the crash barrier or at some point along the side of the crash barrier. If the oncoming vehicle strikes the crash barrier a glancing impact along the side of the crash barrier, the vehicle should be deflected away from the roadside structure or road hazard. The track is securely bolted to the road surface or otherwise fastened to the ground.

The series of telescoping members are slidably mounted along the length of the track. The base of the members are designed to slidably engage the track so that the members cannot be laterally dislodged. The members are designed to successively overlap one another such that they may be substantially collapsed one within the next. When fully extended along the length of the track, the telescoping members may slightly overlap so that one tends to keep the next on the track and the members can telescope properly.

The telescoping members should have at least one side wall that is substantially parallel to the track. The side wall should be sufficiently strong to withstand the expected impact energy of a vehicle colliding with the side walls of the telescoping members of the crash barrier. For example, the side wall may be formed of three-eighth inch (⅜") plate steel, which if property reinforced should be sufficient to withstand the force of an oncoming vehicle weighing four-thousand pounds (4,000 #) and traveling at fifty-five miles per hour (55 m.p.h.) that strikes the side wall at an angle up to forty-five degrees (45°). The side wall may be formed of a stronger or weaker material as conditions warrant. The side wall should be exposed to the anticipated direction of an oncoming vehicle. The telescoping members may have two side walls facing the opposite sides of the track so that the crash barrier can withstand the impact of a colliding vehicle from either side.

The telescoping members may each have a reinforcing bulkhead that does not interfere with the telescoping or nesting ability of the members. For example, the bulkhead may reinforce the side wall or side walls at one end of the member, that is, when the member is slidably aligned on the track, the bulkhead may be located near either the front end or the back end of the member. The bulkhead is oriented perpendicular to the track and the side wall or side walls to provide lateral reinforcement to the side wall or side walls. If the bulkhead is near the portion of the members that slightly overlap when the members are fully extended, the nested position of the members allows the bulkhead on one member to support not only the side walls on that same member, but also the bulkhead on one member may support the side walls of the adjacent member that slightly overlaps with the bulkhead.

The first member, that is, the member that is positioned foremost toward the front end of the track, should also have a front wall. The first member may be exposed to a head on impact of an oncoming vehicle. If the first member is also the smallest member such that no other members are designed to nest within the first member, then the front wall of the first member may be reinforced with an interior bulkhead. The interior bulkhead of the first member may be positioned parallel to the track, between a rear lateral bulkhead and the front wall of the first member. The front end of the first member may also be equipped with a grabbing material, such as a rubber bumper or rubber nose. The grabbing material may fictionally grip or engage the front end of an oncoming vehicle and prevent the vehicle from riding up over the top of the crash barrier.

Tensioners are a means for absorbing the kinetic energy of an impact. Each tensioner may be preferably formed of an elastic material such as rubber. Using tension rather than compression is the most effective method of using an elastic material to absorb the kinetic energy of an impacting vehicle. Each tensioner absorbs the kinetic energy by converting the kinetic energy into strain energy within the tensioner. As will hereinafter be explained in more detail, the energy curve for stretching an elastic material is substantially linear according to Hooke's law. The energy curve for using an elastic material in compression is non-linear. As will hereinafter be explained in more detail, the stored kinetic energy may be used to restore the crash barrier to a substantially pre-impact condition.

Each tensioner may consist of any resilient material, for example a mechanical spring or any type of rubber or rubber-like material. Provided, however, that the resilient material of the tensioner is sufficiently strong to absorb the impact without damaging the material or stretching the material beyond its elastic limit. When the crash barrier is fully deflected under the impact of the maximum force that the crash barrier is designed to withstand, each tensioner is preferably stretched only about one half of the elastic limit of the resilient material.

One or more tensioners may be used. Where multiple tensioners are used they are installed in parallel and staggered. The first tensioner having one end engaged with at least one of the telescoping members that is positioned at or near the front end of the track when the telescoping members are fully extended along the length of the track. The other end of the first tensioner is engaged to the front end of the track. A second tensioner may be installed with one end engaged near the middle of the length of the track and the other end engaged with one of the middle telescoping members further down the track.

When the series of telescoping members are fully extended along the length of the track, the tensioners should be in a substantially relaxed or low tension state. The force of an impacting vehicle may transfer kinetic energy to the telescoping members at the front end of the track such that the members have a tendency to slide toward the rear of the track. The tensioners provide a resisting force to the sliding motion of the members. The tensioners also provide a means for absorbing at least some of the kinetic energy of the impacting vehicle. Much of the impact energy may be converted to potential energy, also referred to as strain energy or tension energy within each tensioner.

Under the impact of an oncoming vehicle, each tensioner may move from a substantially relaxed condition to a substantially strained condition. Once the impact energy has been substantially absorbed by the tensioners and converted into strain energy, the tensioners will have a tendency to return to their relaxed condition. This stored strain energy should not be allowed to violently expend itself.

A braking system is used to cause each tensioner to release the strain energy in a controlled manner so that the stored strain energy of each tensioner can be used to safely and easily restore the telescoping elements to a substantially pre-impact condition. But the brake system is preferably a one-way brake that should allow the telescoping members to slide under the impact of a collision from the fully extended position toward a nested condition toward the rear of the track, resisted mostly by the stretching of the tensioners connected to the telescoping members. In other words, the brake system should operate to control the slidable movement of the telescoping members in response to the accumulated strain or tension energy in the tensioners. The brake system may comprise a jack or rachet system, an alligator gripping system, a compression clutch or any other suitable one-way braking system.

The brake system could alternatively be designed to totally prevent the slidable movement of the telescoping members in response to the accumulated strain energy in the tensioners until a service crew arrives, but then the crash barrier would not protect the roadside structure in the interim before the maintenance crew arrives at the scene and releases the braking system. In most circumstances it is more advantageous to have the crash barrier substantially self-restore within a few minutes of the impact.

The stored strain energy in the tensioners should be able to restore the crash barrier to about fifty (50) to seventy-five (75) percent of the fully extended pre-impact condition.

Therefore, it is an object of the invention to provide a crash barrier that effectively protects roadside structures from impacting vehicles. It is another object of the invention to provide a crash barrier that deflects oncoming vehicles away from protected roadside structures or roadside hazards. It is an object of the invention to provide a crash barrier that absorbs at least some of the kinetic energy of an impacting vehicle, especially the kinetic energy of a vehicle impacting the front end of the crash barrier head on. It is yet another object of the invention to provide a crash barrier that may convert at least some of the kinetic energy to strain or position energy so that at least some of the strain energy may be used to restore the crash barrier to a substantially pre-impact condition. It is also an object of the invention to use one or more tensioner elements to absorb impact energy by converting the impact energy into strain energy, which is the most efficient method of using a tensioner element. The crash barrier could be fully restored to a fully extended condition with a relatively small additional force (compared to the impact force) applied to extend the telescoping members. The crash barrier may have a substantially closed structure so that debris, sand, brush, etc. does not collect in the crash barrier. It is another object of the invention to provide a crash barrier that is more aesthetically pleasing than many of the prior art crash barriers in use. Further features, advantages, and object of the invention will be readily apparent to those skilled in the art from the following detailed description of a preferred embodiment.

BRIEF DESCRIPTION OF THE DRAWING

Drawings of preferred embodiments of the invention are annexed hereto so that the invention may be better and more fully understood in which.

Numerical references are employed to designate like parts throughout the various figures of the drawings.

DESCRIPTION OF A PREFERRED EMBODIMENT

Figure 1:
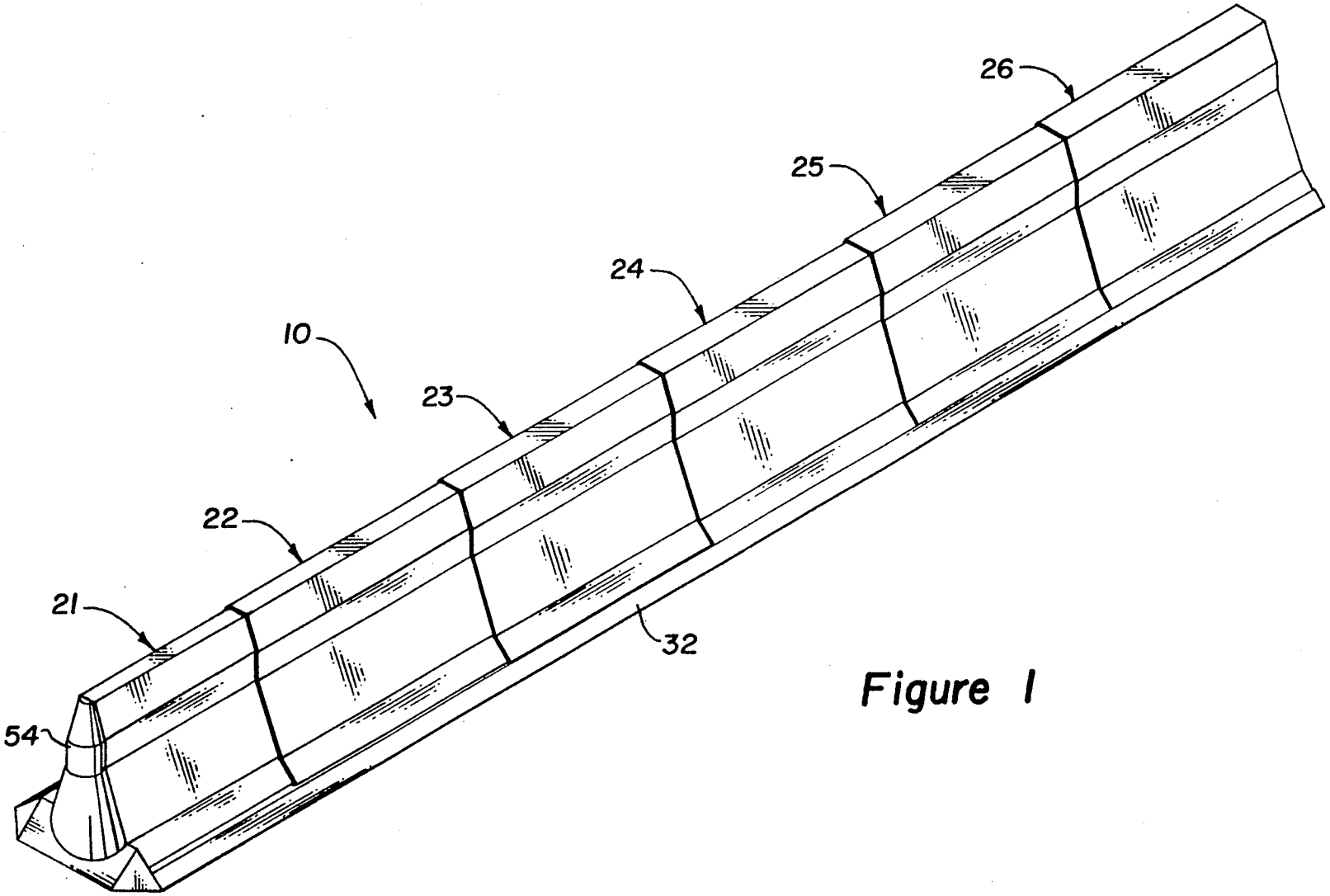
FIG. 1 is a perspective view of one preferred embodiment, of the crash barrier of the invention.

Referring now to FIGS. 1-4 of the drawing, the numeral 10 generally designates a preferred embodiment of the crash barrier of the invention. The numerals 21-26 designate particular telescoping members of the series of six telescoping members of the crash barrier 10, while for convenience of description the numeral 20 generally designates any one or all of the telescoping members 21-26 of the crash barrier 10. The crash barrier 10 of the invention may have fewer or more than the six telescoping members 21-26 shown in this preferred embodiment. The telescoping members 20 are slidably mounted onto a track system, generally referred to as track 30.

For convenience of description, the end of the crash barrier 10 near the telescoping member 21 is referred to as the front of the crash barrier 10. Likewise, the end of the crash barrier 10 near the telescoping member 26 is referred to as the rear or back of the crash barrier 10. As will hereinafter be explained in more detail, the front of the crash barrier 10 is normally oriented toward the general direction of prevailing vehicle traffic. The length of the crash barrier 10 and the length of the several telescoping members 20 refers to the general direction of slidable motion along track 30. The width of the crash barrier 10 and the width of the telescoping members 20 refers to the generally horizontal dimension that is perpendicular to the direction of slidable motion along track 30. Finally the height of the crash barrier 10 and the height of the telescoping members 20 refers to the generally vertical dimension that is perpendicular to the direction of slidable motion along track 30.

Figure 7:
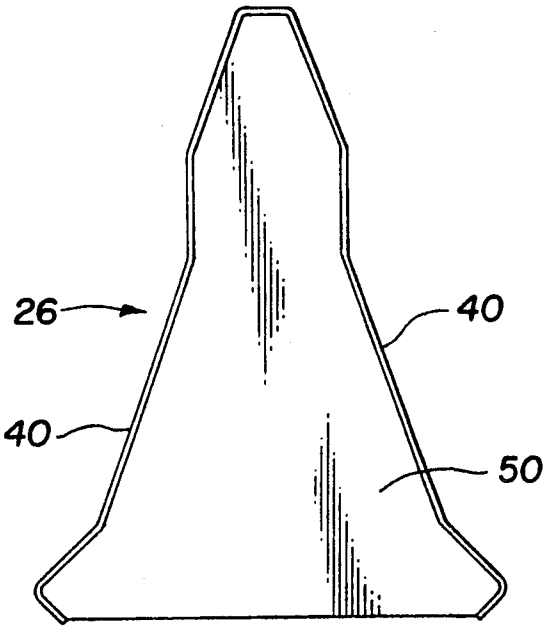
FIG. 7 is an end view of a telescoping member of the crash barrier of FIG. 1.
Figure 6:
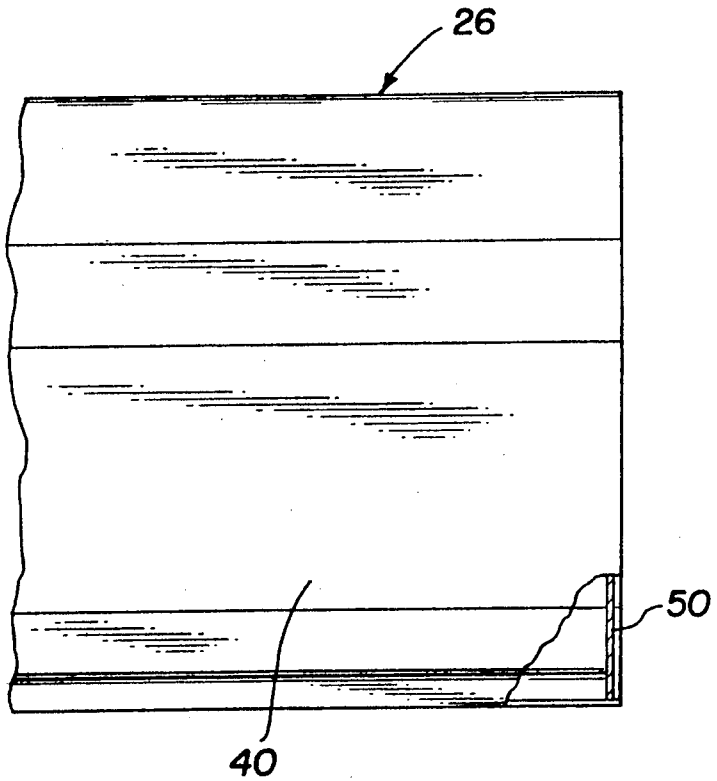
FIG. 6 is a side view of a segment of a telescoping member of the crash barrier of FIG. 1.

In a preferred embodiment of the invention best shown in FIGS. 6 and 7 of the drawing, the telescoping members 20 are formed of three-eighths inch (⅜") plate metal. The plate metal is preferably steel. The plate steel is nondeformable under large impact forces. The telescoping members 20 have two generally vertical side walls 40 and a bulkhead 50. The bulkhead 50 provides lateral structural support to the side walls 40. As will hereinafter be explained in more detail, the nested or telescoping alignment of the telescoping members 20 provides that the end of the member 20 that is farthest from the bulkhead 50 is reinforced by the bulkhead of the next member 20. When mounted onto the track 30, the telescoping members 20 of this embodiment should be sufficiently strong to withstand the impact of a four-thousand pound (4,000 #) vehicle traveling at fifty-five miles-per-hour (55 m.p.h.) that strikes the side walls 40 of the crash barrier 10 at an angle up to about forty-five degrees (45°) relative to the length of the crash barrier 10. Crash barriers 10 can be designed with thicker plate metal to withstand greater impacts.

Figure 4:
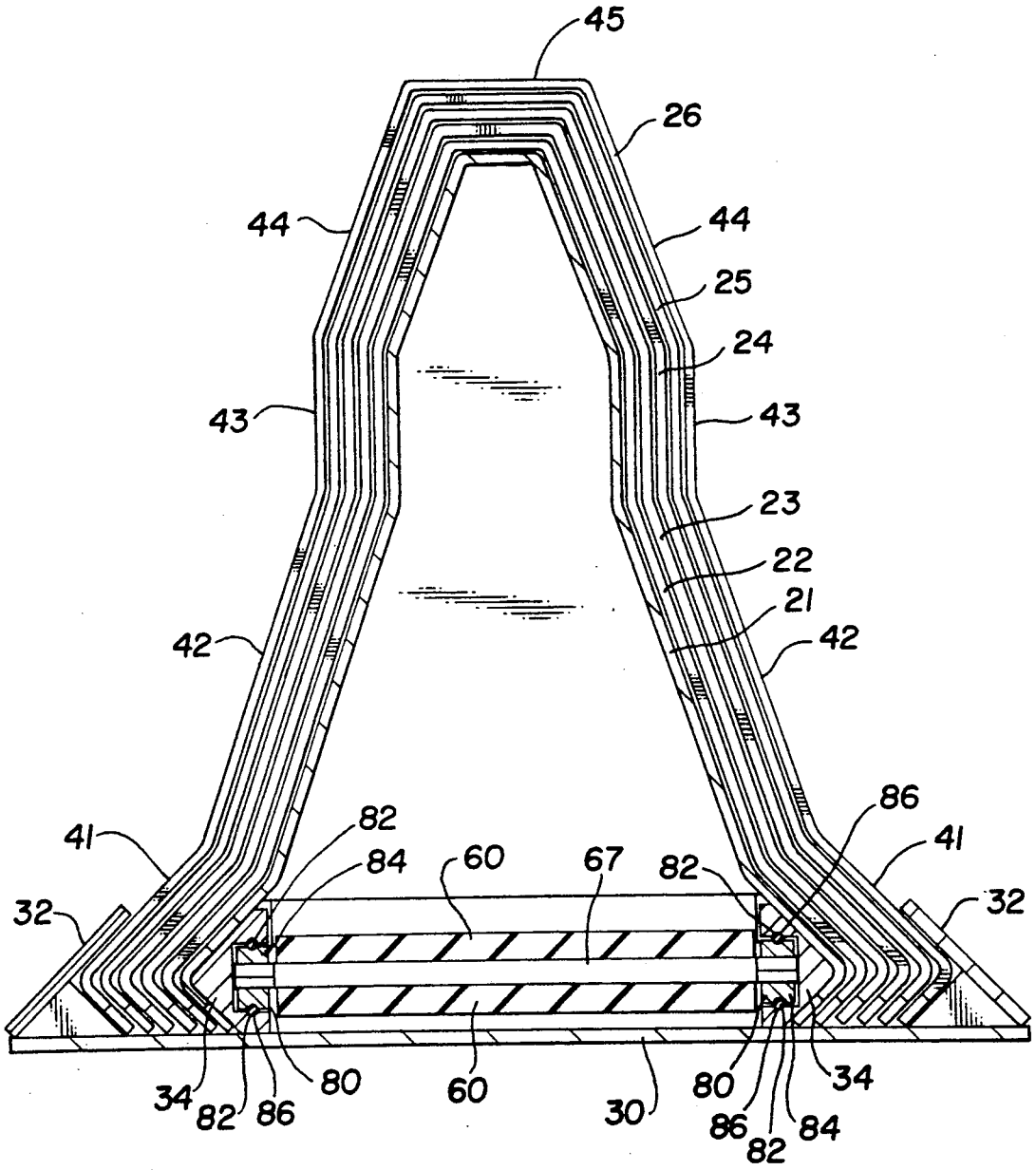
FIG. 4 is a front cross-section view of the crash barrier of FIG. 1.

Referring now particularly to FIG. 4, the telescoping members 20 have side walls 40 comprised of side wall segments 41, 42, 43, 44, and 45. The length of the side wall 40 is substantially parallel to the track 30 so that the impact energy of a vehicle approaching at an angle to the track 30 is deflected lengthwise along the side of the crash barrier. The various angles of the side wall segments 41-45 to the vertical plane that is parallel to the length of the track system are designed to at least partially deflect an oncoming vehicle up or down. The overall configuration of the side walls 40 of the telescoping members 20 is designed to at least partially deflect an oncoming vehicle along the length of the crash barrier 10.

In the preferred embodiments shown in the drawing, the side walls 40 of the telescoping members 20 are symmetrical about a vertical plane that passes through the center line of the length of the track 30. The symmetrical design is advantageous for protecting structures that might suffer an impact from either side of the crash barrier 10. Such a structure includes, for example, a road divider. The symmetrical design is also advantageous from a manufacturing standpoint. Even if a protected structure might be subject to vehicular impact from only one side of the crash barrier 10, the symmetrical design obviates the need for right- and left-hand versions of the crash barrier 10. Nevertheless, the crash barrier 10 of the invention may include non-symmetrical telescoping members 20 for special applications. A crash barrier 10 for a race track or a truck may require tremendous strength from one side but not the other, and manufacturing the symmetrical version might be cost prohibitive in terms of raw materials.

The telescoping members 20 shown in the preferred embodiment form a substantially closed structure. Air is free to circulate between the members, but debris, sand, brush, etc. is excluded from the interior of the crash barrier 10 and kept away from the track 30. Therefore, debris does not collect inside the crash barrier 10 and does not have to be periodically cleaned out of the crash barrier.

The telescoping members 20 may be of different lengths, but in the preferred embodiment shown in the drawings, all the telescoping members 20 have the same length. In the preferred embodiment, the members 20 have a length of about three (3) to four (4) feet. But each of the telescoping members 20 is designed to have a different cross-section so that they may telescopically fit within one another.

For example, in the preferred embodiment shown in the drawings, the overall width of member 21 is about twenty-four inches (24") and the overall height of the member 21 is about thirty inches (30"). The interior cross-section of member 22 should be large enough to accommodate the overall dimensions of the smaller member 21. Assuming that the telescoping members are formed of three-eighths inch (⅜") plate steel and assuming that sufficient additional spacing should be provided so that the members 20 do not become wedged together at an angle, the overall width of member 22 should be at least about one inch (1") greater than for member 21, or about twenty-five inches (25"). Similarly, the overall height of member 22 should be at least one-half inch (½") greater than the overall height of member 21, or about thirty-point-five (30.5) inches. Therefore, the telescoping members 21–26 become progressively larger. Telescoping member 26 has an overall width of about six inches (6") greater than the overall width of member 21, and member 26 has an overall height of about 3 inches (3") greater than the overall height of member 21.

In the preferred embodiment shown in FIGS. 1–7, the telescoping members 20 can telescopically nest within one another such that the rear surface of bulkhead 50 of member 21 touches the front surface of bulkhead 50 of member 22. Likewise the rear surface of bulkhead 50 of member 22 touches the front surface of bulkhead 50 of member 23, and so on.

Figure 2:
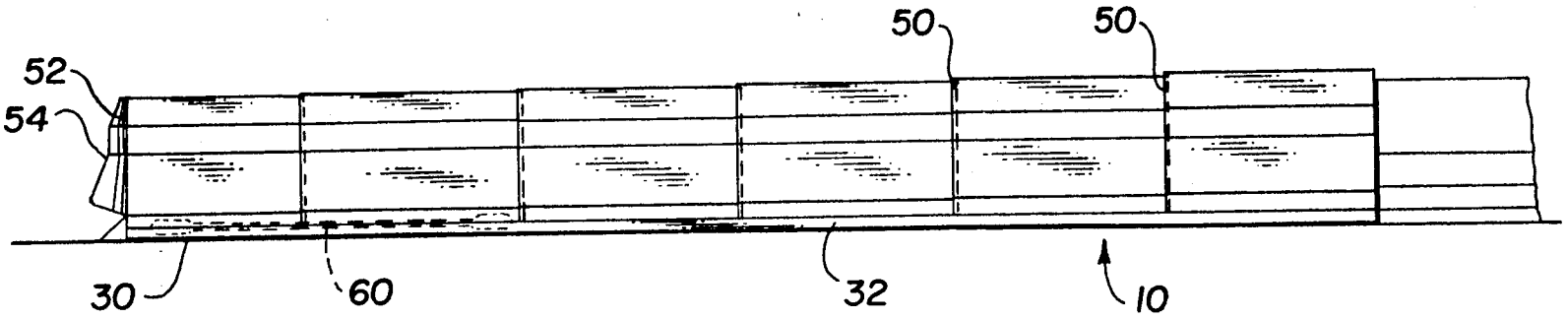
FIG. 2 is a side elevation view of the crash barrier of FIG. 1.
Figure 3:
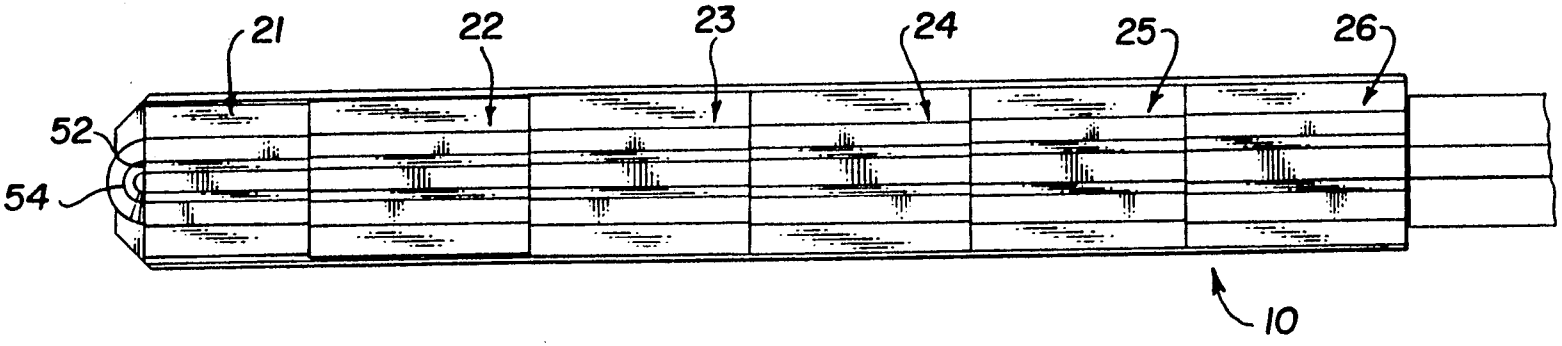
FIG. 3 is a top plan view of the crash barrier of FIG. 1.

As best shown in FIGS. 1–3 of the drawing, the first telescoping member 21 should preferably have a front wall 52. The front wall 52 may have substantially the same configuration of wall segments as the side walls 40 so that the connection between the front wall 52 and the side walls 40 present a contiguous surface to an oncoming vehicle. As best shown in FIGS. 2 and 3, the first telescoping member 21 may also be equipped with a gripping material, such as rubber nose 54. The rubber nose serves to frictionally engage the contacting portion of an oncoming vehicle so that the vehicle does not ride up and over the crash barrier 10. The rubber nose 54 may also help guide the impacting vehicle down the track so that more of the impact energy may be absorbed by the tensioner 60, as will be hereinafter explained in more detail.

The track 30 is formed of a heavy duty metal such as steel. The track 30 is firmly bolted or otherwise fastened to the surface of the road or other platform. Reinforced concrete is an ideal surface for bolting the crash barrier 10. The track 30 should be bolted to the surface at several places along the length of the track 30 so that the track 30 does not become misaligned under the impact of a vehicle. When bolted down, the track 30 should be able to support the telescoping members 20 against the impact of an oncoming vehicle. As will hereinafter be explained in more detail, if the track 30 becomes misaligned, the telescoping members 20 cannot slidably move along the track 30 and the crash barrier 10 might not function properly.

In the preferred embodiment of the invention illustrated in the drawing, the track 30 comprises outer rails 32 and inner rails 34. The angular shape of the side walls 41 of the telescoping members 20 is adapted to slidably engage both outer rails 32 and inner rails 34. In the preferred embodiment, the outer rails 32 and the inner rails 34 are parallel. Assuming the dimensions of the telescoping members 20 of the preferred embodiment, the distance between the outer rails 32 and the inner rails 34 could be as little as three inches (3"). The outer rails 34 could be slightly tapered instead of parallel so that distance between the outer rails 32 and the inner rails 34 would be narrowed to about one inch (1") near telescoping member 21. When fully extended along the track 30, the telescoping members 20 should have a lengthwise overlap of about two inches (2").

In the preferred embodiment of the invention, the overall length of the track 30 is about twenty (20) to twenty-five (25) feet. The track 30 can be pre-fabricated as a whole prior to installation at a remote roadside location. The pre-fabricated track 30 can easily fit onto the flatbed of a truck. If the track 30 has been prefabricated, the outer rails 32 and the inner rails 34 do not have to be aligned at the highway location sd that the whole track system 30 can be bolted down to the top of the pavement in one piece without concern for careful alignment measurements. Of course, the track 30 should be properly aligned to meet oncoming traffic.

The telescoping members 20 are slidably aligned by three restraining systems: (a) the outer rails 32, which primarily hold the larger members in slidable alignment; (b) the inner rails 34, which primarily hold the smaller members 20 in slidable alignment, and (c) the nesting or telescoping engagement of the members 20 between themselves, which holds one member 20 in slidable alignment with the next.

The track 30 is oriented such that when the crash barrier 10 is fully assembled, the telescoping members 20 on the track 30 are oriented substantially lengthwise toward the direction of oncoming traffic. As shown in FIGS. 1–4, the front end of telescoping member 21 would generally face oncoming traffic, thereby providing maximum protection to the structure behind the crash barrier 10.

Figure 5:
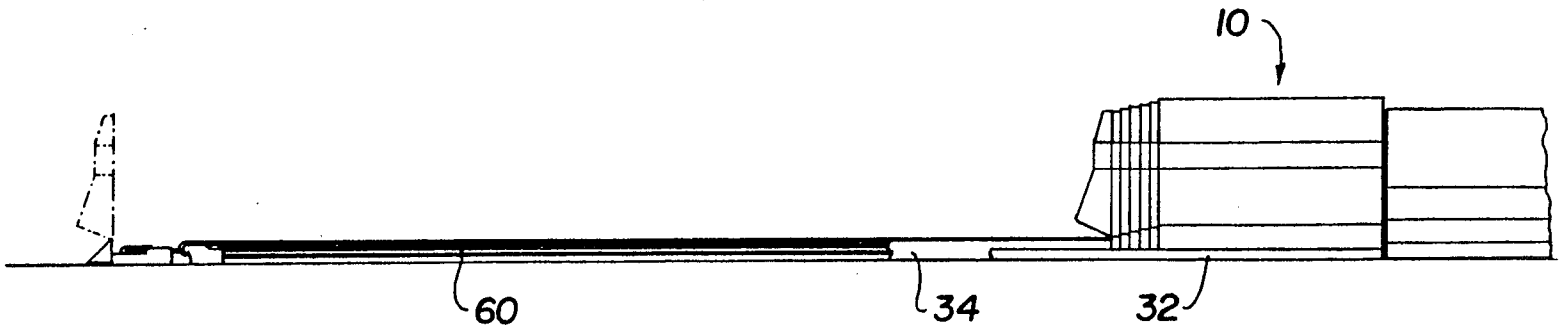
FIG. 5 is a side elevation view of the crash barrier of FIG. 1 showing the barrier fully deflected.
Figure 8:
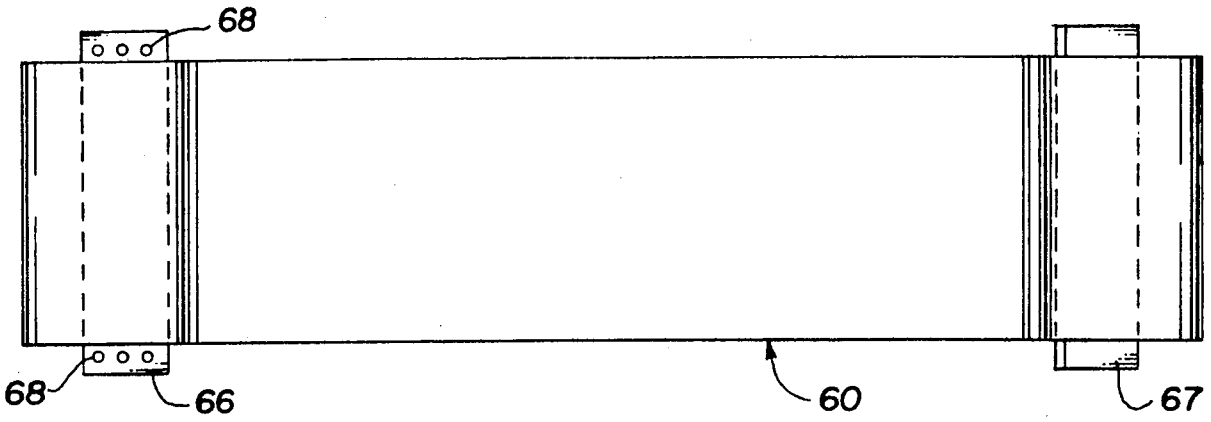
FIG. 8 is a top plan view of a tensioner element of the crash barrier of FIG. 1.
Figure 9:
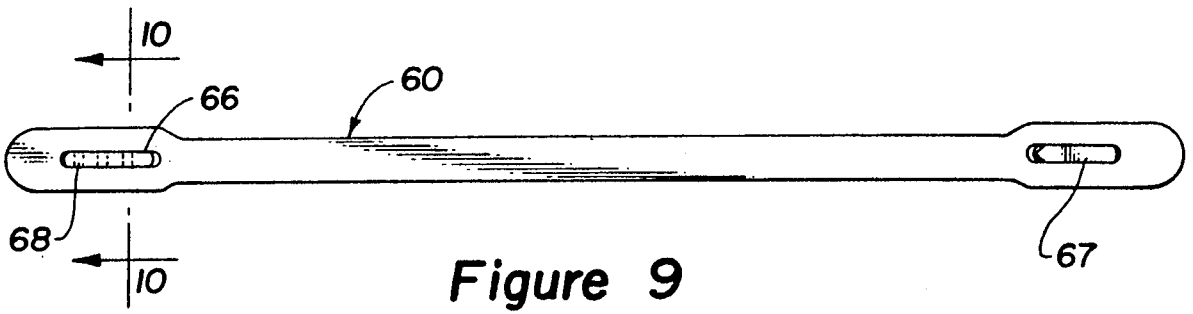
FIG. 9 is a side elevation view of a tensioner element of the crash barrier of FIG. 1.
Figure 10:
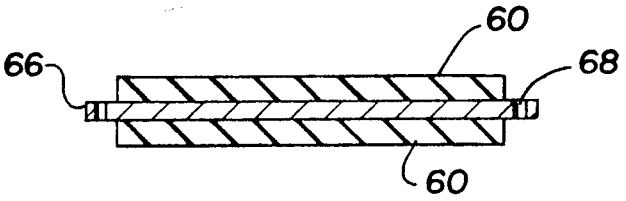
FIG. 10 is a cross-section view of a tensioner element of FIG. 9 taken along line A—A.

As best shown in FIGS. 4 and 5, a tensioner 60 is connected between the second telescoping member 22 and the other end of the tensioner 60 is engaged to the front end of the track 30. In the preferred embodiment, the tensioner 60, best shown in FIGS. 8–10, essentially comprises a band of rubber. A rubber having suitable elastic properties includes rubber no. D64-80, available from Regal International, Inc. The band of rubber has receptacles 64 at either end with a front reinforcing plates 66 and a rear reinforcing plate 67 positioned therethrough. The front reinforcing plate 66 has screw eyes 68 therethrough so that the front end of the tensioner 60 may be bolted or otherwise attached to the front end of the track 30. The other end of the tensioner is anchored in the brake system 80. As best shown in FIG. 4, part of the brake system 80 is attached to the second telescoping member 22, as will hereinafter be described in more detail.

One end of the tensioner 60 is slightly stretched and connected to the front end of the track 30. The tensioner is most easily engaged with the front end of the track 30 when the telescoping members 20 of the crash barrier 10 are in the fully extended condition such that the first member 21 is nearest the front end of the track 30. Once the tensioner 60 is engaged, the low strain in the tensioner 60 maintains the second telescoping member 22 near the front end of the track 30. When the telescoping members 20 of the crash barrier 10 are in the fully extended condition, the tension in the tensioner 60 is low, merely being sufficient to engage the second member 22 to the front end of the track.

Under the impact energy of an oncoming vehicle, particularly a vehicle approaching head on to the front end of the crash barrier 10, the impact tends to force the first member 21 backward. In the preferred embodiment of the members 20, once the first member is moved back three to four feet, the bulkhead 50, located near the rear of member 21, will contact the bulkhead 50 of member 22. When the first member 21 engages the second member 22, then the second member 22 begins to move backward under the impact of the collision. As the impact energy is transferred to the crash barrier 10, each of the members 21–26 will be successively pushed back into the next member.

As the first member 22 moves backward, the distance increases between the point of attachment of the tensioner 60 to the second telescoping member 22 and the point of attachment of the tensioner 60 to the front end of the track 30. As the distance increases, the tensioner 60 stretches. The elastic nature of the tensioner 60 tends to balance some of the impacting energy of the oncoming vehicle. The elastic nature of the tensioner essentially obeys Hooke's law, that is the force required to stretch the elastic material is directly proportional to the distance of distortion from the relaxed state.

The tensioner 60 is preferably attached to the second telescoping member 22 for several reasons. Of course, the tensioner 60 should still be within the elastic limit of the tensioner material even when the telescoping members 21–26 are completely telescoped together. But the tensioner 60 needs to be of a sufficient length so that when the members 20 of the crash barrier are fully telescoped into one another and the tensioner 60 becomes stretched between the front end of the track 30 and the members 20 at the rear of the track 30, the tensioner 60 is not stretched beyond the elastic limit. Preferably when the members 20 of the crash barrier 10 are fully telescoped into one another, the tensioner 60 should be stretched about three-hundred percent (300%). Therefore, if the tensioner in the substantially relaxed position is approximately the length between the front end of the track 30 and the rear end of telescoping member 22, the tensioner 60 is about one-third (⅓) the length of a crash barrier 10 having six (6) telescoping members 21–26. The preferred rubber material for the tensioner 60 should have an elastic limit of greater than six-hundred percent (600%). But if the tensioner 60 is stretched toward its elastic limit, it becomes much more susceptible to fatigue, tearing, or cutting.

The tensioner 60 should be able to absorb sufficient impact energy so that for most collisions with the crash barrier, the second to last member 25 should be unlikely to travel all the way into the last member 26. The inherent strength of the members 20, the track 30, the tensioner 60, should allow the crash barrier 10 to absorb this kinetic energy without significantly deforming the members 20 or damaging the track 30. Then the crash barrier 10 may self-restore within a few minutes to between about fifty (50) and seventy-five (75) percent of the pre-impact condition. The crash barrier 10 should be capable of being restored to full operating condition with minimal replacement parts and maintenance work.

The tensioner 60 absorbs energy in proportion to elastic distortion of the material. As best shown in FIG. 5, once the impact energy of the vehicle is spent, the accumulated strain energy in the tensioner 60 becomes a problem. If unrestrained, the tensioner could violently rebound to the relaxed state. Therefore, a brake system 80 should be incorporated into the crash barrier 10 of the invention to control the release of the strain energy.

Figure 12:
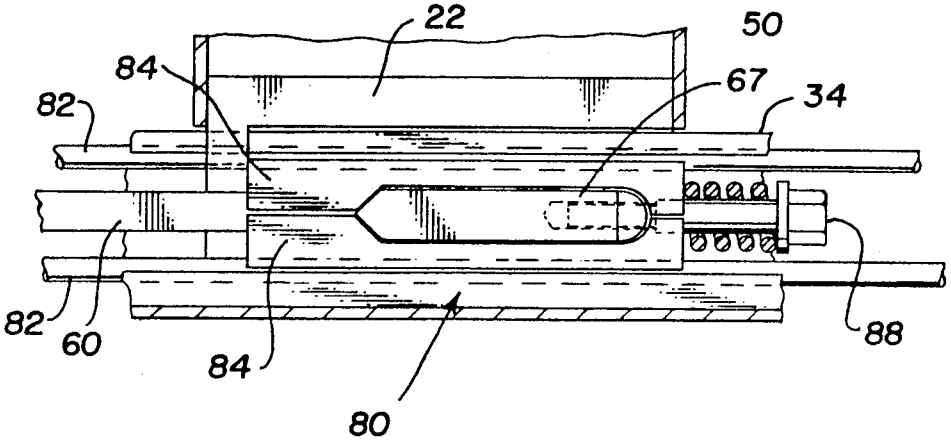
FIG. 12 is a side elevation view of the braking device of FIG. 11 in an activated position.
Figure 11:
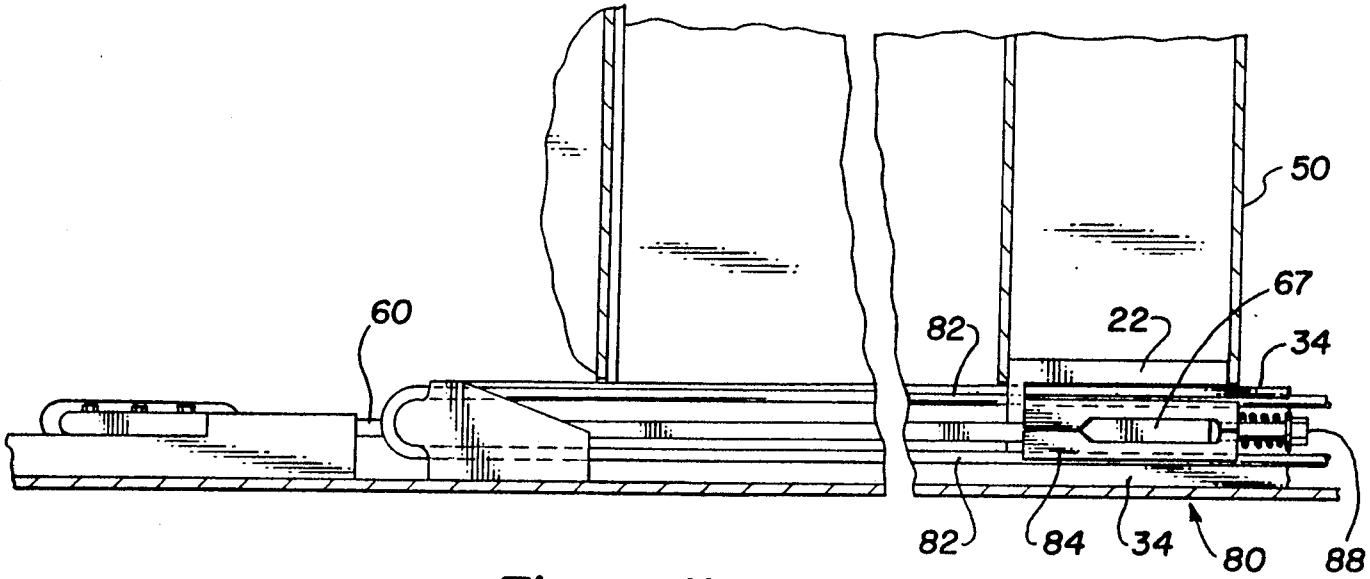
FIG. 11 is a side elevation view of the braking device of the crash barrier of FIG. 1.

As best shown in FIGS. 4, 11, and 12, the brake system 80 generally comprises at least one brake cable 82, a wedge 84, and a bore 86. The bore 86 is formed within each of the inner pair of rails 34. The shape of the bore 86 is such that the brake cables 82 are partially recessed within the upper and lower portions of the bore 86. The wedge 84 has substantially the same shape as the bore 86 except that the portion of the brake cables 82 that is not recessed within the upper and lower portions of the bore 86 are recessed within the upper and lower portions of wedge 84. The wedge 84 has an opening in which the rear reinforcing plate 67 of the tensioner inserts. The wedge 84 connects to the back of the telescoping member.

The wedge 84 is oriented in the bore 86 such that substantially no frictional resistance is created when the wedge 84 moves from the front toward the rear of track 30. But when the impact energy of the colliding vehicle is spent, the tensioner 60 tends to exert a restoring force back toward the front end of the crash barrier 10. The forward pull of the tensioner 60 tends approach the original rearward force of the original impact. To control the release of the strain energy, the forward pull of the tensioner 60 causes the rear reinforcing plate 67 to bear on the inside surface of the wedge 84, thereby spreading the upper and lower sides of the wedge 84 against the top and bottom of the bore 86. As the upper and lower sides of the wedge spread the friction between the wedge and the cable, and the cable and the bore increases creating a clamping force on the cable 82. The wedge 84 begins to exert a frictional braking force against the cable 82 that substantially, but preferably not completely opposes the high strain energy of the tensioner 60. The greater the restoring force exerted by the tensioner 60, the greater the frictional braking effect of the wedge 84 against the cable 82 and bore 86. Thereby, the kinetic energy of the impacting vehicle that was transferred to strain energy in the tensioner 60 is released in a controlled manner. The tensioner 60 gradually self-restores the telescoping members 20 to between about fifty and seventy-five percent of the pre-impact extended position.

In an alternative embodiment, a rachet system (not shown) could be used to brake the tensioner 60 into the highly strained position. The rachet system could be disposed within the track 30. In yet another alternative embodiment, the brake system could comprise an overriding clutch system (not shown).

In yet another embodiment, multiple tensioners could be employed with each tensioner staggered along the track. With the tensioners in parallel, the resistance to telescoping of the members progressively increases as the barrier compresses, the greatest resistance occurring when all tensioners are in tension.

When help arrives at the scene of the accident, the vehicle can be towed away from the crash barrier 10. Care should be taken to avoid damaging the exposed tensioner 60. However, in the preferred embodiment, the rubber material of the tensioner 60 is extremely tough.

The wedge 84 has a screw 88 thereon for adjusting the frictional resistance of the wedge 84. The screw 88 can be slowly rotated until the frictional resistance approximately equals the strain in the tensioner 60. The telescoping members 20 can then be restored to the fully extended condition with a light tow truck or even a perhaps even a pick-up truck. For convenience, a tow hook to facilitate towing (not shown) could be placed under the rubber nose 54. The elastic tensioner 60 normally should not require replacement. The crash barrier 10 of the invention could in most instances be restored on the spot at the time of the accident by one or two maintenance men and few if any spare parts. The tension adjustments to the tensioner 60 and the brake system 80 are simple to make.

If desired, the crash barrier 10 could be repainted whenever convenient. The paint serves to protect the metal of the crash barrier 10 and make the crash barrier 10 more visible to traffic. Alternatively, the telescoping members 20 of the crash barrier 10 may be galvanized to increase the durability of the crash barrier.

Numerous alterations, modifications, and changes can be made in the design of the invention without departing from the scope and spirit of the invention and defined by the claims.

What is claimed is:

1. An improved crash barrier assembly for use alongside a vehicle roadway to protect structures along the roadway from the effects of vehicle impacts, the crash barrier assembly comprising:

(a) a plurality of members of a size and shape to telescope;

(b) means for mounting said members so that said members may telescope between an elongated condition and a compressed condition, whereby said means for mounting said members can be positioned adjacent a roadside structure such that said members are generally oriented to telescope in a direction of prevailing vehicle traffic flow; and (c) at least one elastic tensioner, said tensioner being connected to one of said telescoping members for resiliently opposing the telescoping motion of said members toward the compressed condition whereby at least part of the kinetic energy of an oncoming vehicle is absorbed as strain energy as said members slidably telescope together under the impact of the oncoming vehicle.

2. The crash barrier assembly of claim 1 wherein said members form an enclosed shape so that the interior of the crash barrier assembly is substantially isolated from the environment, thereby minimizing the accumulation of debris.

3. The crash barrier assembly of claim 1 having a sufficient strength to absorb the impact of a four-thousand pound vehicle traveling at fifty-five miles-per-hour that strikes the crash barrier assembly head on.

4. The crash barrier assembly of claim 1 having a sufficient strength to withstand the impact of a four-thousand pound vehicle traveling at fifty-five miles-per-hour that strikes the crash barrier assembly at an angle of up to forty-five degrees.

5. The crash barrier assembly of claim 1 wherein said means for mounting said telescoping members comprises a track.

6. The crash barrier assembly of claim 1 wherein said tensioner is formed of a rubber material.

7. A crash barrier for deflecting an incoming vehicle away from a roadside structure and for protecting the roadside structure from the impact of the vehicle, the crash barrier comprising:

(a) a track, said track having a front end and a back end;

(b) a plurality of telescoping members, said members including at least a first member and a last member, said members slidably mounted on said track; and (c) at least one resilient tensioner, one end of said tensioner engaged to one of said members near the front end of said track and the other end of said tensioner engaged to the front end of said track whereby said tensioner tends toward a strained condition when said series of telescoping members is fully retracted along said track such that said members are near the back of said track.

8. The crash barrier of claim 7 wherein said members additionally have a bulkhead for structurally reinforcing said side wall.

9. The crash barrier of claim 7 wherein said members are formed of plate steel.

10. A method of protecting a roadside structure from the effects of vehicle impacts, the method comprising the steps of:

(a) mounting a track system adjacent to a roadside structure such that the track system is generally oriented toward the direction of prevailing vehicle traffic flow;

(b) placing a plurality of telescoping members onto the track system such that the telescoping members are extended along the length of the track system; and (c) connecting one end of a resilient tensioner to the front end of the means for mounting the telescoping members and connecting the other end of the tensioner to one of the telescoping members that is near the front end of the means for mounting the members;

whereby when a vehicle impacts the telescoping members, the telescoping members collapse onto one another under the force of the impact, the impact energy being opposed by the stretching of the tensioner and absorbed by the tensioner until the impact energy is dissipated and absorbed as position energy in the tensioner.

11. An improved crash barrier assembly for use alongside a vehicle roadway to protect structures along the roadway from the effects of vehicle impacts, the crash barrier assembly comprising:

(a) a plurality of members of a size and shape to telescope;

(b) means for mounting said members so that said members may telescope between an elongated condition and a compressed condition, whereby said means for mounting said members can be positioned adjacent a roadwide structure such that said members are generally oriented to telescope in a direction of prevailing vehicle traffic flow;

(c) means for resiliently opposing the telescoping motion of said members toward the compressed condition whereby at least part of the kinetic energy of an oncoming vehicle is absorbed as train energy as said members slidably telescope together under the impact of the oncoming vehicle; and (d) means for braking the strain energy developed in said means for resiliently opposing the telescoping motion of said members under the impact of an oncoming vehicle so that the strain energy may be released under controlled conditions to at least partially restore the telescoping members to the elongated condition.

12. The crash barrier assembly of claim 11 wherein said means for braking the strain energy developed in said means for elastically opposing the telescoping motion of said members comprises a wedge, said wedge being positioned adjacent said means for mounting said telescoping members and being connected to one of said telescoping members, said wedge allowing said members to move toward the compressed condition under the force of an impacting vehicle, but said wedge providing frictional resistance with said means for mounting said telescoping members when the force of the strain energy developed in said means for resiliently opposing the telescoping motion of said members under the impact of an oncoming vehicle so that the strain energy may be released under controlled conditions to at least partially restore the telescoping members to the elongated condition.

13. A crash barrier for deflecting an incoming vehicle away from a roadside structure and for protecting the roadside structure from the impact of the vehicle, the crash barrier comprising:

(a) a track, said track having a front end and a back end;

(b) a plurality of telescoping members, said members including at least a first member and a last member, said members slidably mounted on said track;

(c) at least one tensioner, one end of said tensioner engaged to one of said members near the front end of said track and the other end of said tensioner engaged to the front end of said track whereby said tensioner tends toward a strained condition when said series of telescoping members is fully retracted along said track such that said members are near the back of said track; and (d) a releasable brake system, said brake system allowing said telescoping members to retract under the impact of a vehicle while allowing the tensioner to move from the relaxed condition toward the strained condition, but said brake system controlling said tensioner so that the strain energy of said tensioner may be used to at least partially restore said plurality of telescoping members to the extended position along said track.

14. The crash barrier of claim 13 wherein said brake system comprises a cable disposed within a trough within said track and a wedge slidably mounted adjacent said cable, said wedge fictionally engaging said cable when said tensioner is in the strained condition.

15. A crash barrier for deflecting an incoming vehicle away from a roadside structure and for protecting the roadside structure form the impact of the vehicle, the crash barrier comprising:

(a) a track, said track having a front end and a back end and having inner and outer rails;

(b) a plurality of telescoping members, said members including at least a first member and a last member, said members slidably mounted on said track between said inner rails and said outer rails; and (c) at least one tensioner, one end of said tensioner engaged to one of said members near the front end of said track and the other end of said tensioner engaged to the front end of said track whereby said tensioner tends toward a strained condition when said series of telescoping members is fully retracted along said track such that said members are near the back of said track.

16. The crash barrier of claim 15 wherein said tensioner is formed of a rubber material.

17. A method of protecting a roadside structure from the effects of vehicle impacts, the method comprising the steps of:

(a) mounting a track system adjacent to a roadside structure such that the track system is generally oriented toward the direction of prevailing vehicle traffic flow;

(b) placing a plurality of telescoping members onto the track system such that the telescoping members are extended along the length of the track system;

(c) connecting one end of a tensioner to the front end of the means for mounting the telescoping members and connecting the other end of the tensioner to one of the telescoping members that is near the front end of the means for mounting the members; and (d) attaching a one-way brake system to the telescoping members that allows the members to collapse onto one another but partially resists the extending of the telescoping members;

whereby when a vehicle impacts the telescoping members, the telescoping members collapse onto one another under the force of the impact, the impact energy being opposed by the stretching of the tensioner and absorbed by the tensioner until the impact energy is dissipated and absorbed as position energy in the tensioner that urges the telescoping members to restore to the extended position, the one-way brake system controlling the release of the position energy in the tensioner.

18. An improved crash barrier assembly for use alongside a vehicle roadway to protect structures along the roadway from the effects of vehicle impacts, the crash barrier assembly comprising:

(a) a plurality of members of a size and shape to telescope, said members having a shape to enclose the interior of the crash barrier assembly whereby the interior is substantially protected from the environment;

(b) means for mounting said members to that said members may telescope between an elongated condition and a compressed condition, whereby said means for mounting said members can be positioned adjacent a roadside structure such that said members are generally oriented to telescope in a direction of prevailing vehicle traffic flow; and (c) tensioner means for resiliently opposing the telescoping motion of said members toward the compressed condition, said tensioner means being connected to one of said telescoping members whereby said tensioner means is stretched and at least part of the kinetic energy of an oncoming vehicle is absorbed as potential energy as said members slidably telescope together under the impact of an oncoming vehicle.

* * * * *

UNITED STATES PATENT AND TRADEMARK OFFICE

CERTIFICATE OF CORRECTION

PATENT NO. : 5,217,318
DATED : June 8, 1993
INVENTOR(S) : George W. Peppel

It is certified that error appears in the above-indentified patent and that said Letters Patent is hereby corrected as shown below:

In Column 3, line 40, change "fictionally" to -- frictionally --;

In Column 8, line 41, change "sd" to -- so --;

In Column 10, line 47, after the word "tends", insert the word -- to --;

In Claim 11, Column 13, line 5, change "roadwide" to -- roadside --;

In Claim 14, Column 13, line 67, change "fictionally" to -- frictionally --.

In Claim 18, Column 14, line 60, change "to" to -- so --.

Signed and Sealed this

Twelfth Day of April, 1994

Bruce Lehman

*Attest:*

BRUCE LEHMAN

*Commissioner of Patents and Trademarks*

*Attesting Officer*